US007770810B2

(12) United States Patent
Kennard et al.

(10) Patent No.: US 7,770,810 B2
(45) Date of Patent: Aug. 10, 2010

(54) TRACK DEVICE

(76) Inventors: Christopher S. Kennard, 3727 Willowcrest Ave., Studio City, CA (US) 91604; Wayne Carmona, 9160 Beverly Blvd. #205, Beverly Hills, CA (US) 90210

( * ) Notice: Subject to any disclaimer, the term of this patent is extended or adjusted under 35 U.S.C. 154(b) by 0 days.

(21) Appl. No.: 11/279,545

(22) Filed: Apr. 12, 2006

(65) Prior Publication Data

US 2006/0226248 A1 Oct. 12, 2006

Related U.S. Application Data

(60) Provisional application No. 60/671,245, filed on Apr. 12, 2005.

(51) Int. Cl.
*E01B 23/00* (2006.01)

(52) U.S. Cl. ..... 238/10 R

(58) Field of Classification Search ..... 238/10 R, 238/11, 12, 13; 285/399, 400, 397
See application file for complete search history.

(56) References Cited

U.S. PATENT DOCUMENTS 214,545 A * 4/1879 Bacon ..... 285/399
2,984,853 A * 5/1961 Williams ..... 15/145
3,406,993 A * 10/1968 Haynes ..... 403/345
3,609,906 A * 10/1971 Johnson ..... 43/18.5
5,711,227 A * 1/1998 Johnson ..... 104/126
5,887,787 A * 3/1999 Saldana, III ..... 238/10 R
D409,348 S 5/1999 McKie
6,423,388 B1 * 7/2002 Bateson et al. ..... 428/36.3
6,435,421 B1 8/2002 Peterson
6,557,775 B1 5/2003 Brinson et al.

* cited by examiner

*Primary Examiner*—Mark T Le
(74) *Attorney, Agent, or Firm*—Ocean Law; Paul D. Chancellor

(57) ABSTRACT

The track system of the present invention provides dolly track whose joints are substantially seamless, providing a substantially smooth riding surface over the entire length of joined sections of track. The ferrule design of the invention provides ridged piece to piece joining, eliminating pinching and hinging points. This allows multiple assembled track pieces to be moved without damage. The system uses self locking track buckles. A folding cross member system may be folded for ease of movement and placement. In one embodiment, the track is comprised of a carbon fiber hybrid composite with lighter weight and greater strength than prior art steel or aluminum tracks. In addition the track of the present invention does not bend, eliminating the need to reshape or repair the track each time before use.

9 Claims, 7 Drawing Sheets

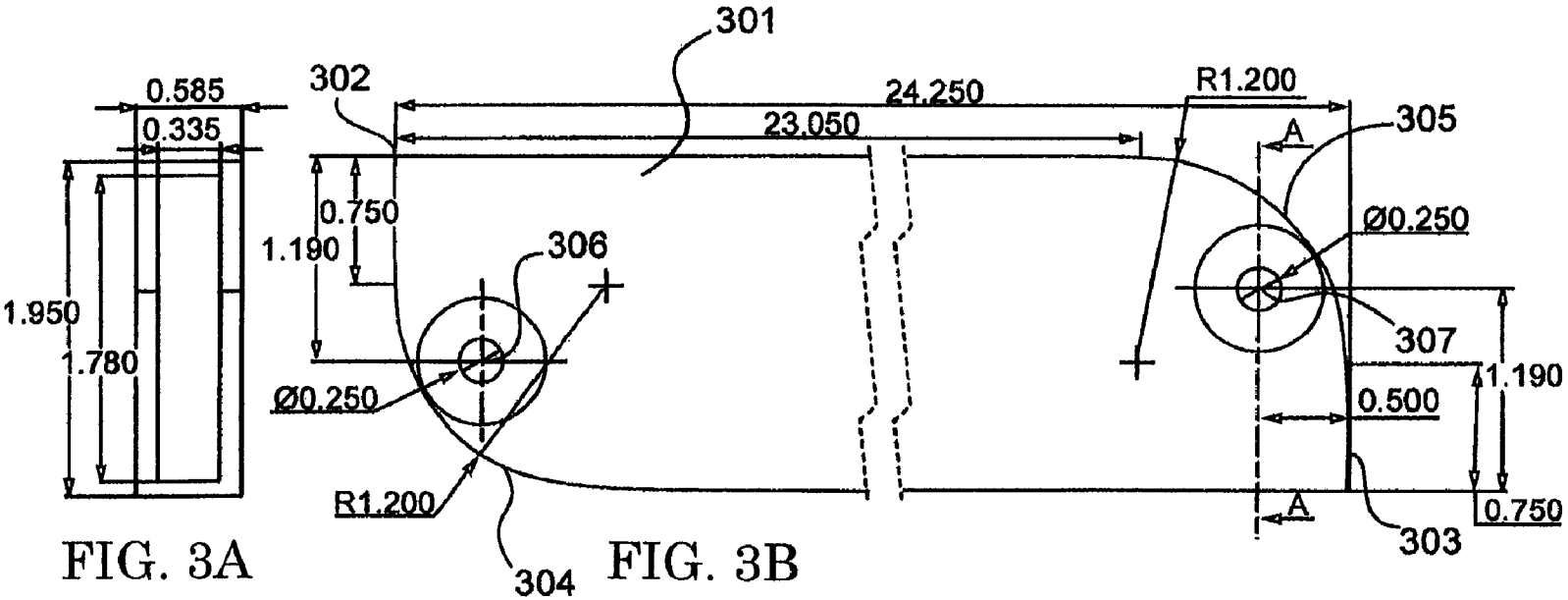
FIG. 3A
FIG. 3B
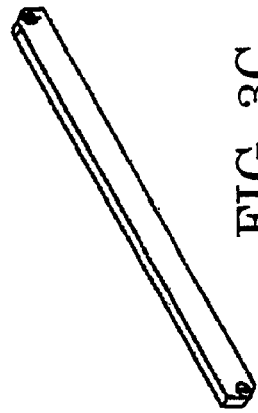
FIG. 3C
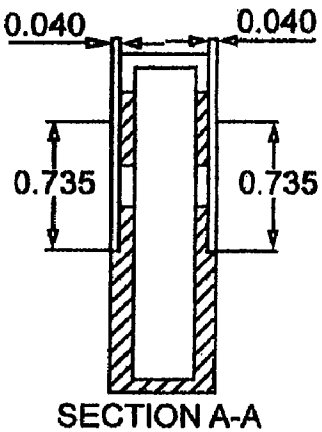
FIG. 3D

TRACK DEVICE

RELATED APPLICATION

This patent application claims priority to provisional patent application 60/671,245 filed on Apr. 12, 2005 and incorporated by reference herein in its entirety.

BACKGROUND OF THE INVENTION

Motion pictures often use cameras mounted on a wheeled dolly for certain shots. The wheeled dolly travels on a track, similar to a train track in that it comprises two rails mounted on cross members.

Dolly track is often rented instead of owned. Not all shots require a dolly mounted camera so it is often useful to rent dollies and dolly track only for scenes or shoots that require it. Because of this, rental track is often mishandled and damaged by renters. Even when owned, dolly track may become worn and damaged by use. This is a problem because an important aspect of the dolly track is to provide a smooth surface for moving the camera during the shot. Imperfections in the dolly track can result in unwanted vibrations in the camera, degrading the camera shot. Because dolly track is comprised of joined sections of track, there are joints between sections that have the potential for creating breaks or bumps in the track surface that can be transmitted to the camera during use. In addition, the dolly wheels traveling over these joints can make unwanted noise that is transmitted to the scene being recorded.

One prior art solution to dolly track problems is to use tube style tracks to provide a smooth surface for the dolly wheels. Even with a tube track, the joints are susceptible to poor joins, leading to unwanted surface variations. One prior art track solution is described in U.S. Pat. No. 6,435,421.

There are a number of disadvantages of prior art track systems. One disadvantage is that it is not possible to carry joined sections of track without damaging the track and increasing the possibilities of poor joint performance. This requires completely disassembling all track pieces when the track is to be moved. This is a time consuming process and adds to the cost of filmmaking. Another disadvantage of prior art track systems is the changing performance when temperatures change. The tracks lack consistent performance over typically temperature ranges of use. Another disadvantage of prior art tube tracks is the method used for joining the track sections. The methods used often result in a poor joint that interrupts the desired smooth surface of track. Another disadvantage is that metal tracks can bend or be dented. When a track section is bent, it must be leveled before it can be used. Often a great deal of time is spend before operation simply in leveling or straightening track sections.

SUMMARY OF THE INVENTION

The track system of the present invention provides dolly track whose joints are substantially seamless, providing a substantially smooth riding surface over the entire length of joined sections of track. The ferrule design of the invention provides ridged piece to piece joining, eliminating pinching and hinging points. This allows multiple assembled track pieces to be moved without damage. The system uses self locking track buckles. A folding cross member system may be folded for ease of movement and placement. In one embodiment, the track is comprised of a carbon fiber hybrid composite with lighter weight and greater strength than prior art steel or aluminum tracks. In addition the track of the present invention does not bend, eliminating the need to reshape or repair the track each time before use.

BRIEF DESCRIPTION OF THE DRAWINGS

These and other features, aspects and advantages of the invention will become better understood with regard to the following description, appended claims and accompanying drawings where:

FIGS. 3A-3D illustrate an embodiment of a cross member of the invention.

DETAILED DESCRIPTION OF THE PREFERRED EMBODIMENTS

In the following description of the invention, reference is made to the accompanying drawings that form a part hereof, and in which is shown by way of illustration a specific embodiment in which the invention may be practiced. It is to be understood that other embodiments may be utilized and structural changes may be made without departing from the scope and spirit of the invention.

The invention provides a light and strong dolly track comprised of a carbon fiber/hybrid composite. The material has a certain memory so that even if it is overloaded it does not bend and returns to its true shape each time. It has a very low thermal reactivity so that the track has consistent performance over operating temperatures. The ferrule design of the invention provides a ridged section connection that eliminates pinch/hinging points. This permits assembled track sections to be carried without damaging the track.

Figure 1:
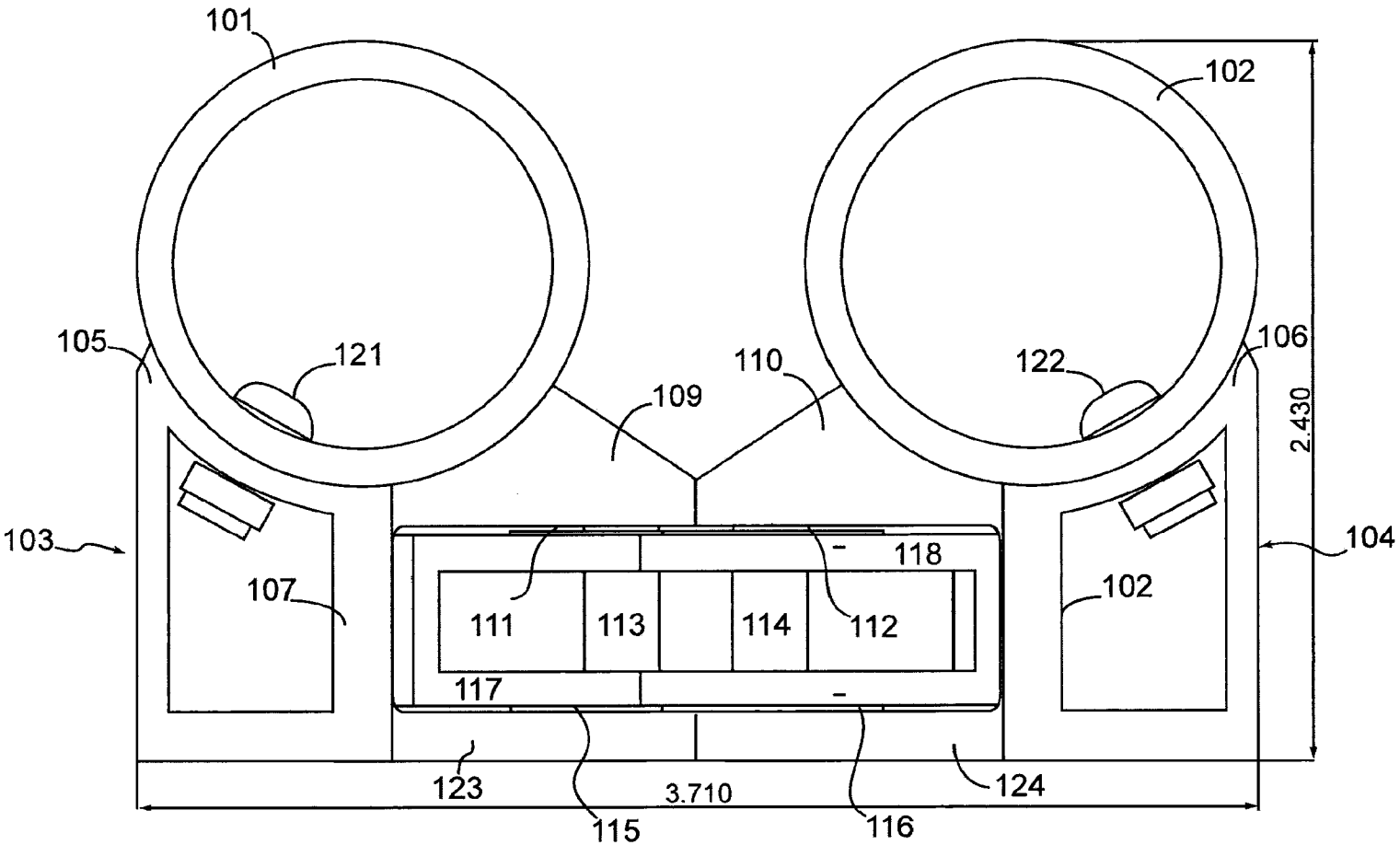
FIG. 1 is a cross sectional end view of an embodiment of the track of the invention.

FIG. 1 illustrates an end view of an embodiment of the invention in a folded position. The track consists of a pair of rail tubes 101 and 102. The tubes rest on support members 103 and 104 respectively. Each support member has a curved section 105 and 106 that receives and holds the tubes 101 and 102. In one embodiment the tubes are bonded to the support members with adhesives. In another embodiment, the tubes are coupled to the support members using mechanical fastening means, such as rivets 121 and 122 illustrated in FIG. 1.

The outside portion of the support members have a substantially rectangular section 107 and 108 that extends to the floor for track support. Upper inner portions 109 and 110 each have a hub 111 and 112 for pivotally mounting the cross members 117 and 118. Sleeves 113 and 114 are pivotally mounted through cross sections 117 and 118 to hubs 115 and 116. When the track rails are moved apart, the pivotally mounted cross sections can rotate from a closed and substantially co-linear position with the tubes to a substantially perpendicular position for track use. As can be seen in FIG. 1, in this embodiment, the rails are slightly separated when the track is in the folded position. The regions 109 and 110 of support members 103 and 104 come together to form a closed portion to protect the cross members from dust or other contaminants when the track section is folded. Sections 123 and 124 form part of the bottom support surface for the track sections. In one embodiment, the bottom surface of the support members are coated with a non-skid coating or material to help hold the track sections in place during use.

Figure 2:
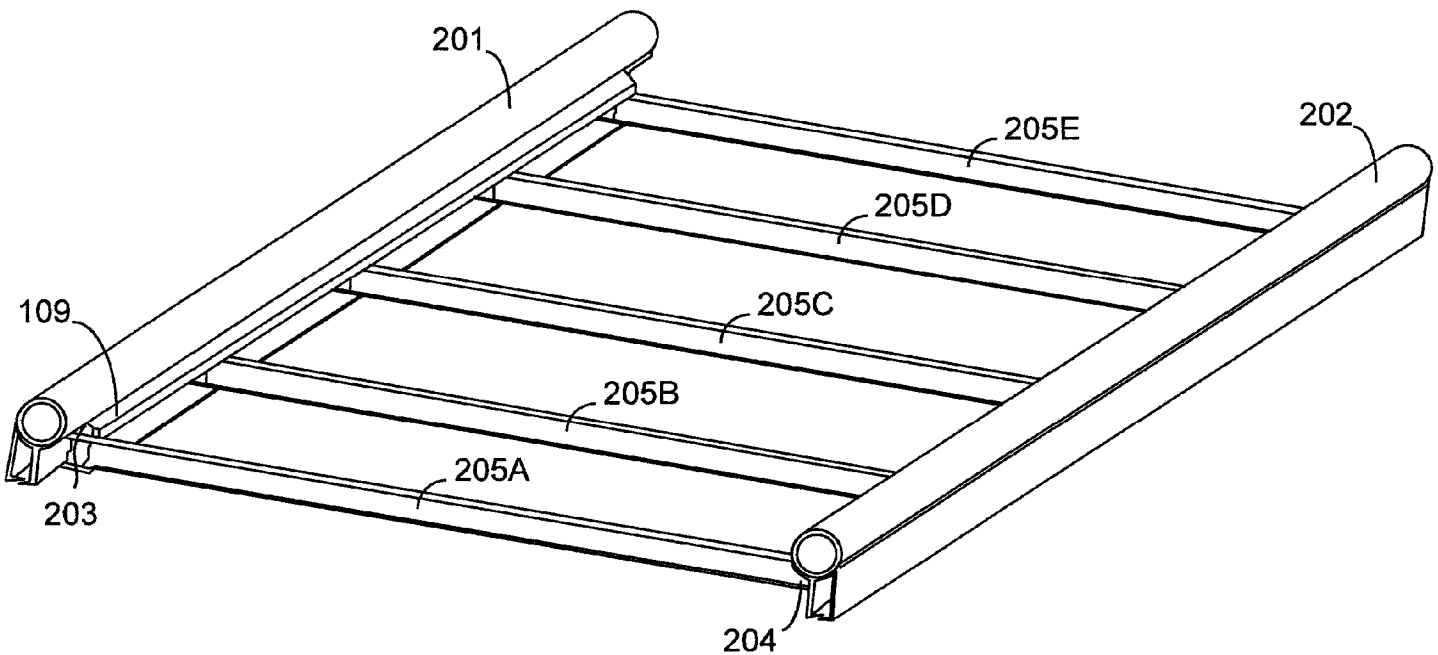
FIG. 2 is an isometric view of the track of FIG. 1 unfolded.

FIG. 2 illustrates an isometric view of one embodiment of a track section unfolded for use. Tube rails 201 and 202 are separated and positioned by cross members 205A-205E. Referring to cross member 205A, it can be seen that it is pivotally mounted to rail 201 at pivot mounting point 203. Similarly, cross member 205A is pivotally coupled to rail 202 at pivot mounting point 204. The cross members can pivot in either direction for ease of use, movement and positioning. As seen in FIG. 2, the inner and upper portion 109 of the support member is recessed from the end of the track and the rest of the support member. In one embodiment, this recess is there so that buckles for joining track sections can be located there.

FIGS. 3A-3D illustrate a cross member of an embodiment of the invention. The cross member 301 includes two sides, each having straight and curved sections. For example the left end of cross member 301 has an upper straight portion and a lower curved portion 304. Conversely the right end of cross member 301 has an upper curved portion 305 and lower straight portion 303. The cross member 302 includes openings 306 and 307 formed therein to permit the pivotal mounting of the cross member to the support members of the rails. In operation, the curved portions 304 and 305 of the cross member 301 permit the rotation of the cross member relative to the rails in one direction for closing. When opening, the straight portions 302 and 303 of the cross member serve as an automatic limit on the rotation of the cross member with respect to the rails, locking the cross member in its desired open position automatically.

Figure 4:
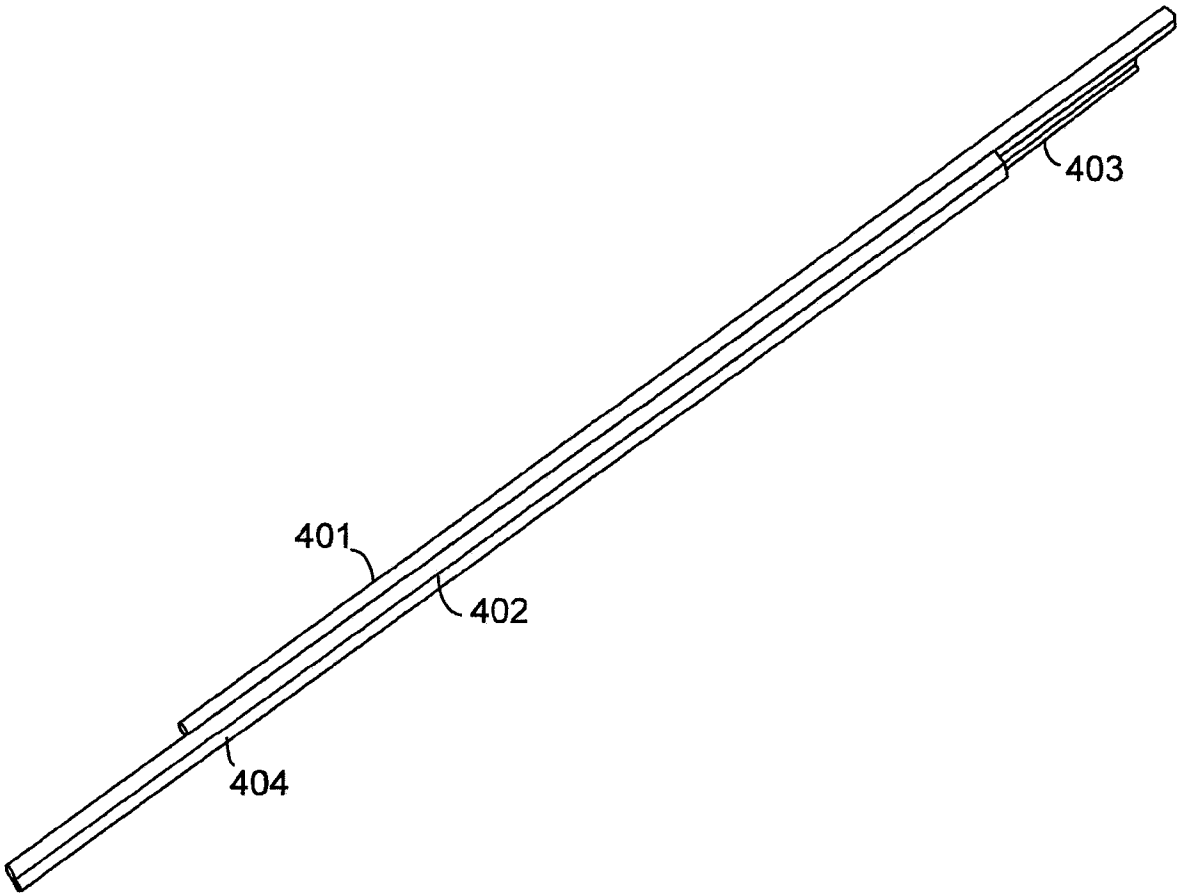
FIG. 4 is a top view of a folded track section.

FIG. 4 illustrates a view of a folded track section. When folded, one rail is offset from the other due to the pivoting action of the cross members. Rail 401 sticks out at one end while rail 402 sticks out at the other end. In FIG. 4, cross member 403 is visible in a folded position at one end of the folded track section.

Figure 5A:
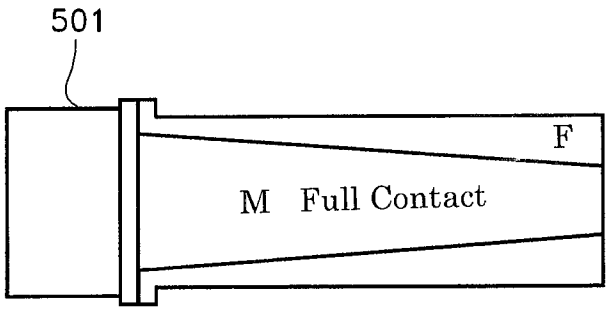
FIGS. 5A-5C illustrate one embodiment of the ferrules of the invention.
Figure 5B:
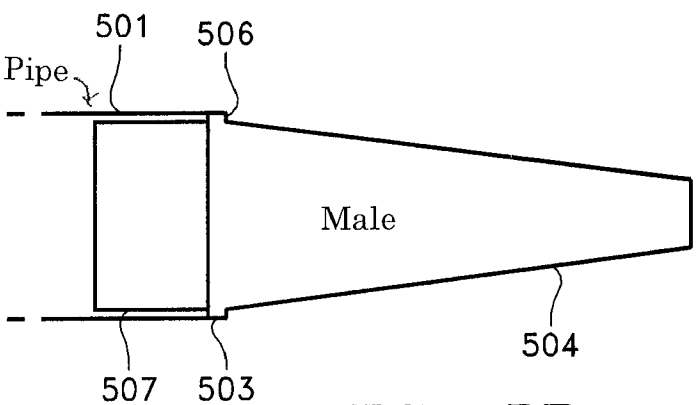
Figure 5C:
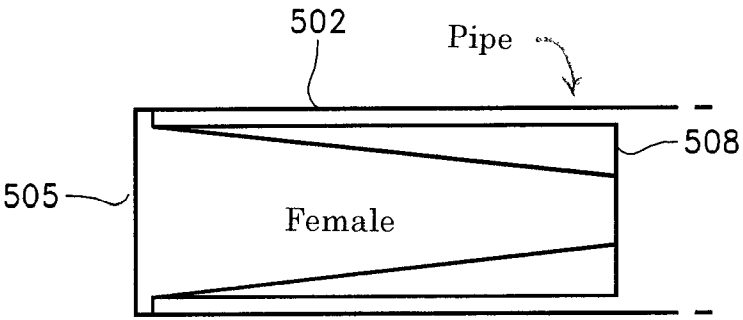

FIGS. 5A-5C illustrate one embodiment of the ferrules used in the invention for joining track sections. Tube rails 501 and 502 are shown from a track section. Rail 501 includes a male ferrule 506 mounted on its end. The male ferrule 506 comprises a cap 503, plug 507 and shaft 504. The cap 503 includes a rim on its edge that has an outer diameter coincident with the outer diameter of the rail 501. The plug 507 is sized such that it can be mounted within the diameter of the rail tube 501. In one embodiment the ferrule 506 is coupled to the shaft by bonding it to the shaft, such as by using adhesives. In one embodiment, the male ferrule shaft 504 is tapered for ease of insertion into the female ferrule 508, shown mounted within rail 502. The female ferrule comprises an inverted tapered cone shape for receiving the tapered shaft 504 of the male ferrule 506.

In operation the shaft 504 of the male ferrule 506 would be inserted into the opening (e.g. opening 505) and ultimately into the tapered opening of female ferrule 508 of rail 502. As can be seen, by having the female ferrule 508 including a tapered opening, the shaft 504 of male ferrule 506 can have full contact with the female ferrule 508, improving strength after joining. After insertion, buckles or some sort of latching members on the cross sections of the track would be locked in place to provide a compression fit of the two track sections. By using the ferrule 506, the joint between the tracks is substantially continuous, with no gaps or raised areas. This is because the track tube is joined face to face with its corresponding partner. When the dolly wheels roll over the joint, it is substantially seamless so that substantially no vibration or sound introduced into the dolly by the joint, providing a smooth travel surface along all joined sections.

The shaft 504 of the ferrule 506 is sized so as to provide a relatively tight fit with in the opening 505 of a rail tube. This provides strength to the joint during use and also the ability to carry joined sections of track without weakness at the joints leading to bends and dents.

Figure 6:
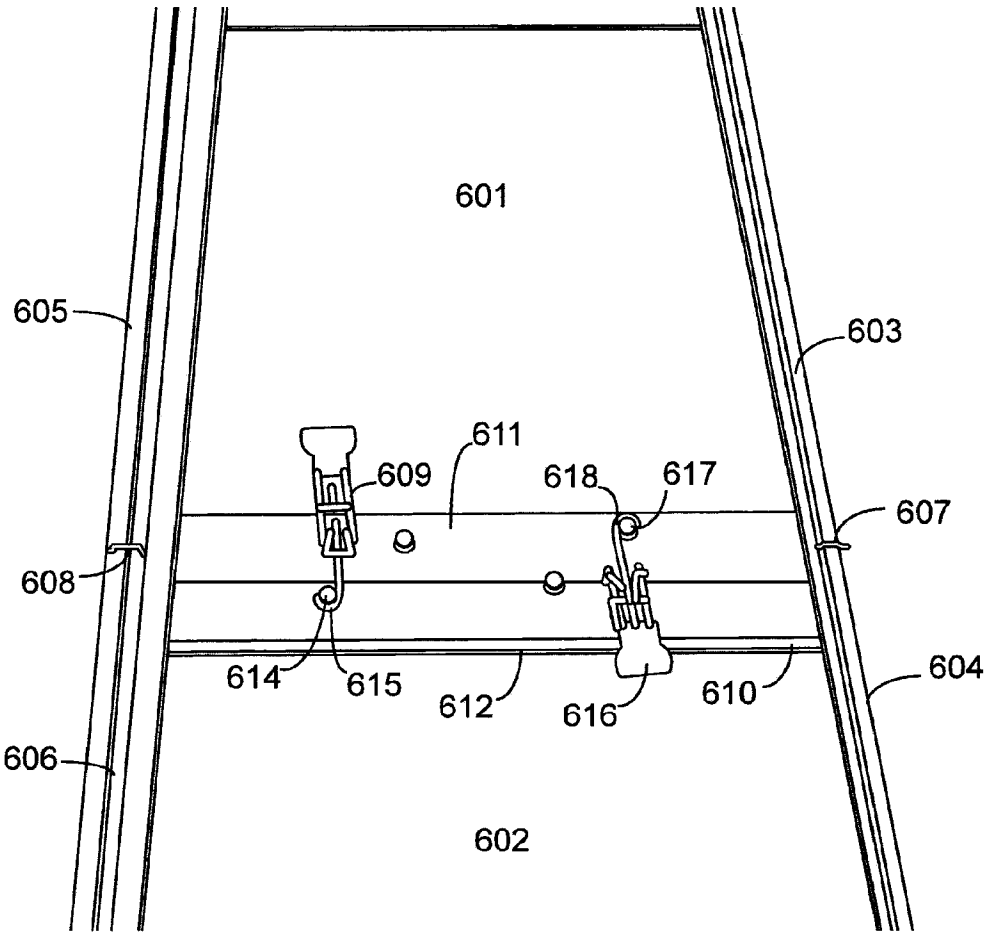
FIG. 6 illustrates the track joining mechanism of the invention.

FIG. 6 illustrates one embodiment of a method of joining and locking track sections in the invention. This figure illustrates two track sections 601 and 602. Track section 601 includes rails 603 and 605, cross member 611, buckle 609, latch 615, pin 617, and ferrule 607. Track section 602 includes rails 604 and 606, cross member 612, buckle 616, latch 618, pin 614, and ferrule 608. In this embodiment, the ends of any pair of tracks include one ferrule and one opening for receiving a ferrule. Here, the shaft of ferrule 607 of track section 601 is inserted into the opening of rail 604, joining rails 603 and 604. Correspondingly, the shaft of ferrule 608 of track section 602 is inserted into the opening of rail 605, joining rails 605 and 606.

To secure the rail sections together and to minimize any gaps at the joints, the invention provides cross members relatively near the ends of the rails and latching mechanisms to lock the two sections together. In the embodiment of FIG. 6, cross member 611 includes a buckle 609 that has a latch 615 that engages a pin 614 on cross member 612. The buckle is then closed, tensioning the latch 615 and pulling the two track sections 601 and 602 towards each other for a secure and tight fit. Similarly, buckle 616 of cross member 612 includes a latch 618 that engages pin 617 of cross member 611. When the buckle is closed, the latch is tensioned and pulls track sections 601 and 602 together in a secure fit.

Figures 7A, 7B, 7C, 7D, 7E:
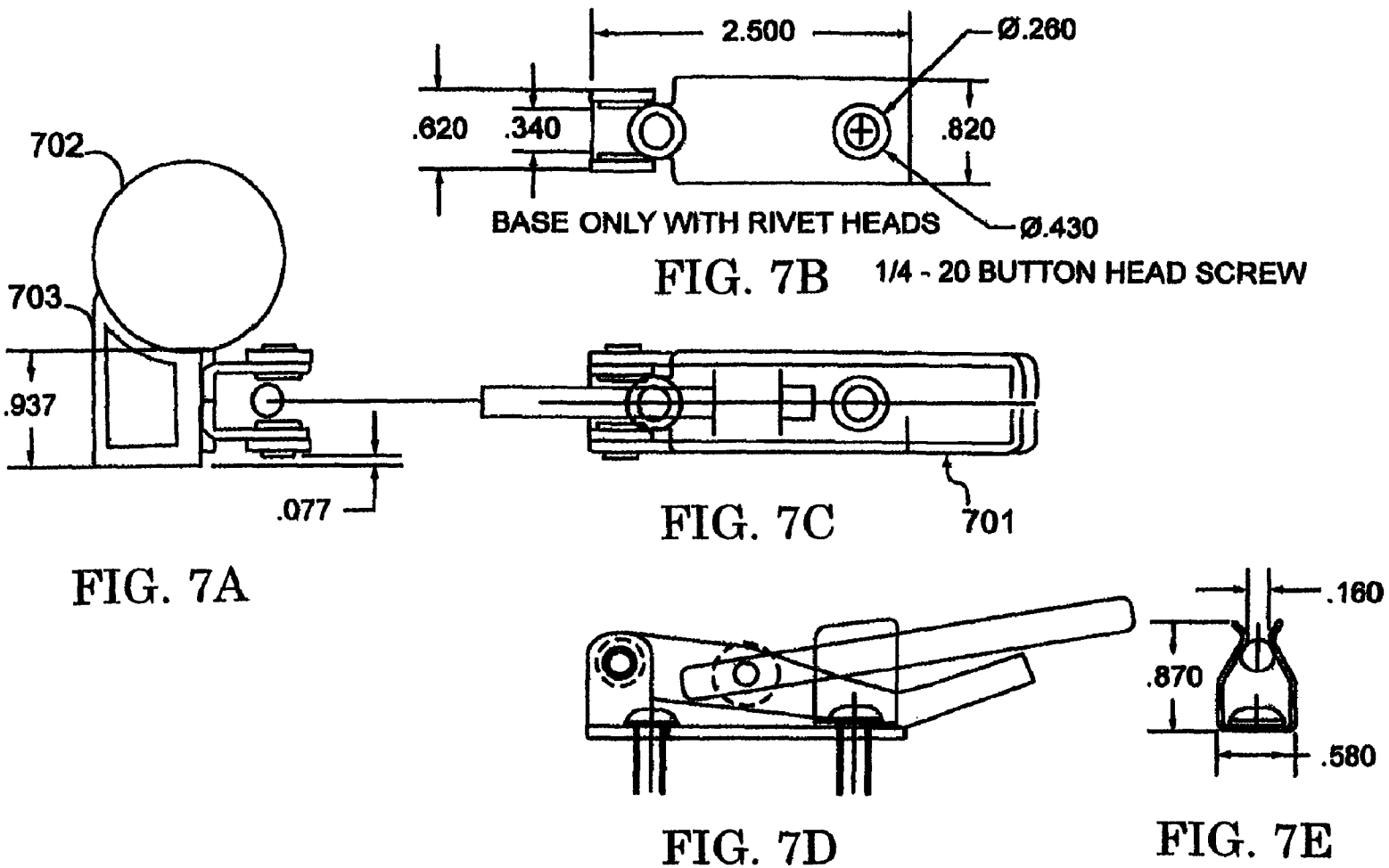
FIGS. 7A-7E illustrate another embodiment of a buckle system for use with the invention.

FIGS. 7A-7E illustrate another embodiment of joining track sections together. FIG. 7A shows a clevis mounted to an inside surface of an interior of support member 703. FIGS. 7B and 7C are different views showing parts of the buckle. FIG. 7D shows a lever rotatably mounted on the clevis, and a latch rotatably mounted on the lever. FIG. 7E shows the latch captured by a fastener. In this embodiment, the buckle 701 is mounted sideways on the support member 703 of rail 702. As noted in FIG. 1, there is an open section at the terminal end of the inner portion of the support member for receiving the buckle 701. A post or pin on the opposite track section receives a latch from buckle 701. A cam lever action is then closed to tighten the buckle and pull the two track sections together as noted above. In one embodiment, the end of each section includes a buckle on one side and a latch post or pin on the other side.

In one embodiment of the invention, the tube is comprised of a hybrid composite of fiberglass and carbon fiber. The material may be worked by pull-trusion or any other suitable means of forming hollow tubes. After initial forming, the ferrules can be placed in the tube such as by adhesive or any other suitable coupling means. The entire tube and ferrule assembly can then be further machined together to the tolerances desired. By doing this processing step in this manner, the problems of machining or producing separate pieces to exact tolerances is minimized and avoided.

What is claimed is:

1. A track assembly comprising:

first and second cylindrical rail tubes coupled to respective support members and a plurality of cross members interconnecting the support members;

each support member including a hollow part and two flanges;

the hollow part including a first side formed to match the curvature of a selected outer circumference of a rail tube;

the first side of the hollow part supporting the rail tube;

the hollow part including a second side, the flanges extending from the second side with a gap therebetween;

the hollow part including a third side for supporting the track;

a cross member having first and second opposed ends;

the first cross member end having an uncurved corner substantially opposite a curved corner;

the second cross member end having an uncurved corner substantially opposite a curved corner;

the uncurved corner of the first cross member end located diagonally with respect to the uncurved corner of the second cross member end;

the curved corner of the first cross member end located diagonally with respect to the curved corner of the second cross member end;

the first cross member end inserted in the gap of the first support member and rotatably coupled to the flanges forming the gap;

the second cross member end inserted in the gap of the second support member and rotatably coupled to the flanges forming the gap;

the track having collapsed and extended states;

in the extended state, the cross members extend between the support members with only the cross member ends located in the respective gaps; and, in the extended state, each uncurved corner limits rotation of the cross member with respect to a support member in one direction.

2. The track assembly of claim 1, wherein in the collapsed state a lengthwise edge of the cross member is located mostly between the flanges of the first support member and an opposed lengthwise edge of the cross member is located mostly between the flanges of the second support member.

3. The track assembly of claim 1, wherein in the collapsed state the cross member is mostly located in a pocket created by opposing flanges of adjacent support members.

4. The track assembly of claim 1, further comprising:

a rail tube circumference about evenly divisible into four consecutive quadrants, the first quadrant meeting the fourth quadrant at a top of the rail tube for supporting dolly wheels; and wherein the selected outer circumference of one rail tube is substantially included in the second or third quadrant of the rail tube circumference.

5. The track assembly of claim 4, further comprising:

a fourth side of the hollow part; and, wherein the second and fourth sides of the hollow part support the rail tube.

6. The track assembly of claim 1 further including:

a buckle for drawing adjacent track assemblies together;

the buckle including clevis, a lever, a latch, and a fastener;

the lever rotatably engaged with the clevis;

the latch rotatably engaged with the lever; and the latch operable to restrain the lever when a midsection of the latch is captured by the fastener.

7. A track assembly comprising:

first and second tubular rails;

first and second support members coupled to the first and second rails to support the first and second rails;

each support member including a hollow part and two flanges;

the hollow part including a first side formed to match the curvature of a selected outer circumference of a rail tube;

the first side of the hollow part supporting the rail tube;

the hollow part including a second side, the flanges extending from the second side with a gap therebetween;

a ferrule having a cap having an outer diameter approximating the outer diameter of the first and second rails, a plug having an outer diameter approximating the inner diameter of the first and second rails, and a conical tapered shaft, mounted at one end of the first rail for engaging an open end of another rail having an inverted tapered cone shape, the ferrule being of a length to prevent bends when joined sections of track are moved;

a plurality of cross members, each cross member having first and second opposing ends, the first end pivotally coupled between the flanges of the first support member and the second end pivotally coupled between the flanges of the second support member;

a first self-locking buckle mounted on an inside surface of an interior of the first support member for engaging a post and joining one track section to another track section, the buckle including clevis, a lever, a latch, and a fastener wherein the lever is rotatably engaged with the clevis, the latch is rotatably engaged with the lever and the latch is operable to restrain the lever when a midsection of the latch is captured by the fastener;

the track having collapsed and extended states; and in the collapsed state a said cross member is enclosed in a pocket created by the flanges of the support members.

8. The track assembly of claim 7 wherein adjacent track sections are connected to form substantially seamless joints included in a substantially smooth riding surface engaged by wheels of a dolly.

9. The track assembly of claim 8 further including a support member post engaged by the latch of a buckle of an adjacent track section.

* * * * *